US005992517A

United States Patent [19]

McAnally

[11] Patent Number: 5,992,517

[45] Date of Patent: Nov. 30, 1999

[54] DOWNHOLE RECIPROCATING PLUNGER WELL PUMP SYSTEM

[76] Inventor: Charles W. McAnally, Harvard Station, Sproul Rd., Fort Davis, Tex. 79734

[21] Appl. No.: 08/953,254

[22] Filed: Oct. 17, 1997

[51] Int. Cl.[6] ..... E21B 43/00

[52] U.S. Cl. ..... 166/105; 417/372; 417/423.3; 417/423.8; 417/424.2

[58] Field of Search ..... 166/105; 417/415, 417/419, 366, 368, 371, 372, 374, 423.3, 423.8, 424.2, 272

[56] References Cited

U.S. PATENT DOCUMENTS 4,392,792 7/1983 Rogers ..... 417/400

*Primary Examiner*—Roger Schoeppel
*Attorney, Agent, or Firm*—Akin, Gump, Strauss, Hauer & Feld, L.L.P.

[57] ABSTRACT

A multicylinder downhole reciprocating plunger pump includes a crankshaft supported on a frame for rotation about an axis generally parallel with the wellbore axis by a submersible electric motor or by a rotary drive rod extending within the well conduit connected to the pump. The pump frame includes spaced apart frame members which support a tubular discharge manifold which supports each cylinder for oscillatory movement in response to rotation of the crankshaft and respective plungers connected to respective crankthrows. Fluid inlet valves are mounted in the plungers and receive inlet fluid through respective crankshaft bearings for each plunger. Fluid discharge valves are retained in respective cylinder head portions by a removable tubular retainer members. Each cylinder includes a liner sleeve with a seal lip biased into engagement with the plunger by a garter spring member. A speed reduction gear drive may be configured to receive well fluid for flow therethrough and be pumped by cooperating meshed gears in the drive housing, for charging the pump inlet. The pump is adapted for waterwells and the speed reduction gear drive and crankshaft and plunger bearings are formed of materials which are water lubricable. The pump is particularly adapted for moderate to deep, low production waterwells.

30 Claims, 5 Drawing Sheets

DOWNHOLE RECIPROCATING PLUNGER WELL PUMP SYSTEM

FIELD OF THE INVENTION

The present invention pertains to a submersible, multi-cylinder, reciprocating plunger pump which may be directly connected to a submersible electric motor or driven by a rotary shaft from the surface. The pump is particularly adapted for low volume waterwells and the pump working components are adapted for lubrication by the working well fluid.

BACKGROUND

Downhole well pumps of various types have been developed for both hydrocarbon producing wells and waterwell applications. A typical submersible waterwell pump, for example, may be a single cylinder reciprocating piston type actuated from the surface by an elongated rod or a centrifugal type directly connected to a submersible electric motor supplied with power by way of conductors extending to a power source on the earth's surface. Waterwells of moderate to extreme depths and in low volume producing formations, in particular, are not suitable for centrifugal pumps due to the inefficiency of these pumps at the high working pressures required of moderate to deep wells and rod driven pumps are not suitable because of the weight of the rod and undesirable dynamics of reciprocating very long rods. Moreover, the development of self contained electric power sources, such as photovoltaic power producing units, for remotely located waterwells requires minimizing pump power requirements, particularly when the well pump is required to produce from rechargeable storage batteries or the like, or when required to produce directly from the photovoltaic source.

Accordingly, there has been a strongly increasing need for the development of high efficiency downhole pumps, particularly adapted for waterwell applications, which are reliable, efficient at high working discharge pressures and low pumped volumes, in particular. Although certain other reciprocating piston pumps have been developed as well as power fluid type pumps, these pumps do not have the efficiency or the mechanical reliability for submersed waterwell applications. The present invention has been developed with a view to avoiding the shortcomings of prior art pumps and to solving the needs for high efficiency, high pressure/low volume pumping applications, particularly in low volume waterwells.

SUMMARY OF THE INVENTION

The present invention provides an improved submersible reciprocating plunger pump, in particular, a pump adapted for use in low volume waterwells of moderate to extreme depths.

In accordance with one aspect of the present invention a multicylinder reciprocating plunger pump is provided which may be adapted for being driven by a submersible electric motor either directly connected to, or through a speed reduction gear drive mechanism, the pump eccentric or crankshaft. Alternatively, the pump crankshaft may be directly driven by an elongated rotary drive shaft or rod extending from a motor disposed uphole or at the earth's surface. In a preferred embodiment of the pump, a triplex configuration is provided and the crankshaft axis of rotation is preferably oriented so as to be substantially parallel to the central longitudinal axis of the well at the pump working position.

In accordance with another aspect of the invention, a multi-cylinder downhole well pump is provided which includes eccentric or crankshaft main bearings and plunger-to-crank bearings which are lubricated by the well fluid, namely water. The fluid inlet port for each cylinder is advantageously formed in the pump plunger and opens into the plunger-crank bearing bore for drawing well fluid through the bearing and into the expansible chamber of each cylinder. An improved arrangement of suction and discharge valves, plunger seal rings and cylinder head support structure is provided. In particular, the latter feature is advantageous in that the head of each cylinder is mounted for oscillating movement on an elongated tubular fluid discharge manifold.

In accordance with still a further aspect of the present invention, an in-the-well motor driven reciprocating plunger pump is provided wherein the pump assembly includes an electric motor connected to a speed reducing gear drive mechanism which is connected to the pump eccentric or crankshaft for driving the crankshaft at a reduced speed with regard to the motor output shaft speed. The speed reducing gear drive is mounted in a housing which is configured to provide for utilizing at least one gear reduction stage to comprise a charging pump for the reciprocating plunger pump. The speed reducing gear drive mechanism housing includes ports for drawing well fluid into and through the housing to charge working fluid to the reciprocating plunger pump and to force the flow of working fluid over the speed reduction gear train to provide lubrication for same. The motor, speed reducing gear housing and pump frame support a generally tubular shroud arranged to provide for the flow of well fluid over the motor, through the speed reduction gear housing and into a "crankcase" space of the reciprocating plunger pump to provide for cooling the motor and the speed reduction gear mechanism as well as the plunger pump and to provide lubrication for the speed reduction gear mechanism and the components of the plunger pump.

The present invention still further provides an in the well reciprocating plunger pump which is driven by an improved elongated rotary drive arrangement through a speed reduction gear drive mechanism connected to an elongated drive shaft extending through the produced fluid tubing string to a motor disposed uphole or at the earth's surface. The speed reduction gear drive arrangement is advantageously lubricated and cooled by the pump working fluid at discharge from the pump. Still further, the pump is provided with a unique arrangement of pressure relief valves to minimize starting effort exerted on the pump by the pump drive mechanism.

Those skilled in the art will further appreciate the above-mentioned advantages and superior features of the invention together with other important aspects thereof upon reading the detailed description which follows in conjunction with the drawing.

DESCRIPTION OF THE PREFERRED EMBODIMENTS

Figure 1:
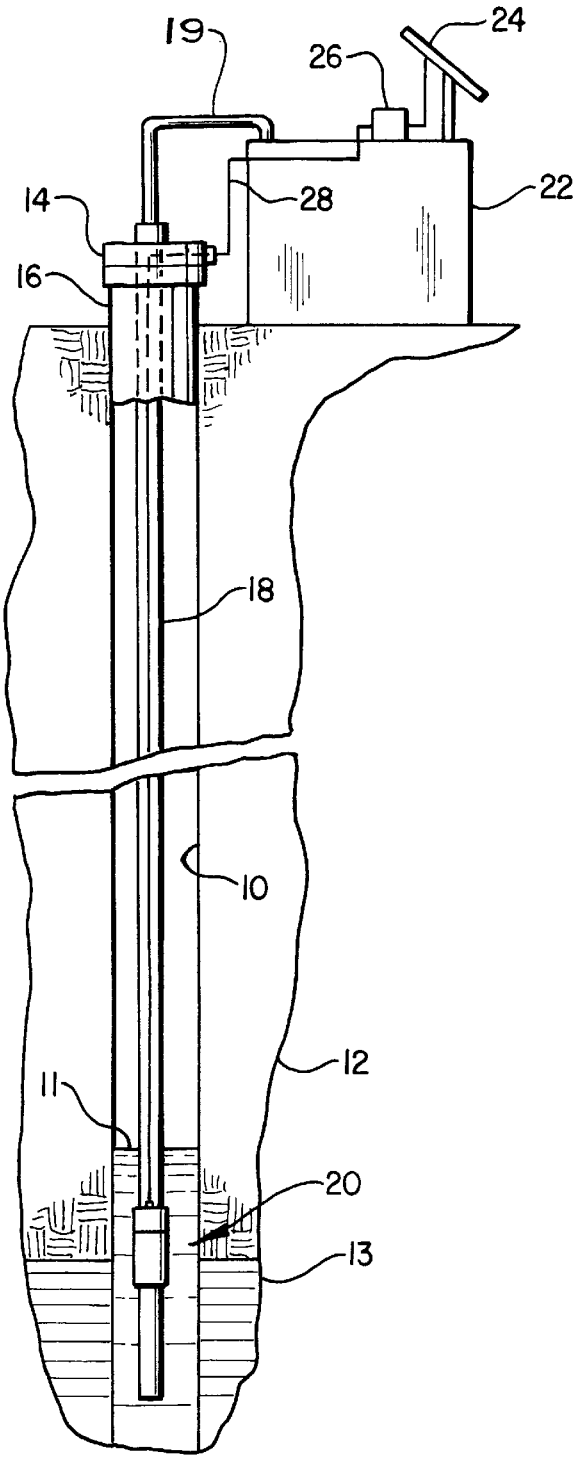
FIG. 1 is a vertical elevation in somewhat schematic form of a fluid producing well showing one embodiment of the pump system of the present invention disposed therein.

In the description which follows like parts are marked throughout the specification and drawing with the same reference numerals, respectively. The drawing figures are not necessarily to scale and certain features may be shown in generalized or schematic form in the interest of clarity and conciseness.

Referring to FIG. 1, there is illustrated a fluid producing well 10 which has been completed into an earth formation 12, including a strata 13 for producing water, for example. The well 10 includes a conventional wellhead 14, including a surface casing 16 and which wellhead supports a depending production fluid conduit 18 extending within the well to a motor driven multicylinder reciprocating plunger pump unit, generally designated by the numeral 20. The pump unit 20 is operable to produce well fluid, such as water, through the conduit 18 to the surface for storage in a suitable storage tank 22, for example. The conduit 18 is operably connected to the storage tank 22 through a connecting conduit 19. One particularly advantageous application of the pump 20 is for producing water from wells of moderate to extreme depth, namely about 700 ft. up to 1,000 ft. depth, and drilled into formations which are relatively low volume producing, namely less than about ten gallons per minute.

Applications of this type advantageously utilize electric energy sources, and in particular, when remotely located, photovoltaic collectors and converters, as indicated by numeral 24. The photovoltaic collector and energy converter 24 is operably connected to a power conversion and storage unit, generally designated by the numeral 26. The unit 26 may include storage batteries and a DC to AC inverter for driving the motor of the pump unit 20 by way of suitable electrical power conductor means 28 extending from the unit 26 to the pump unit 20 through the well 10 and in a generally conventional manner. The power source 24, 26 may, of course, be other than that described. The power conversion unit 26 may or may not include DC power storage batteries and the motor of the pump unit 20 may be a DC motor. However, for waterwell and other downhole applications, conversion of power to AC and use of AC motors is generally preferred.

Figure 2:
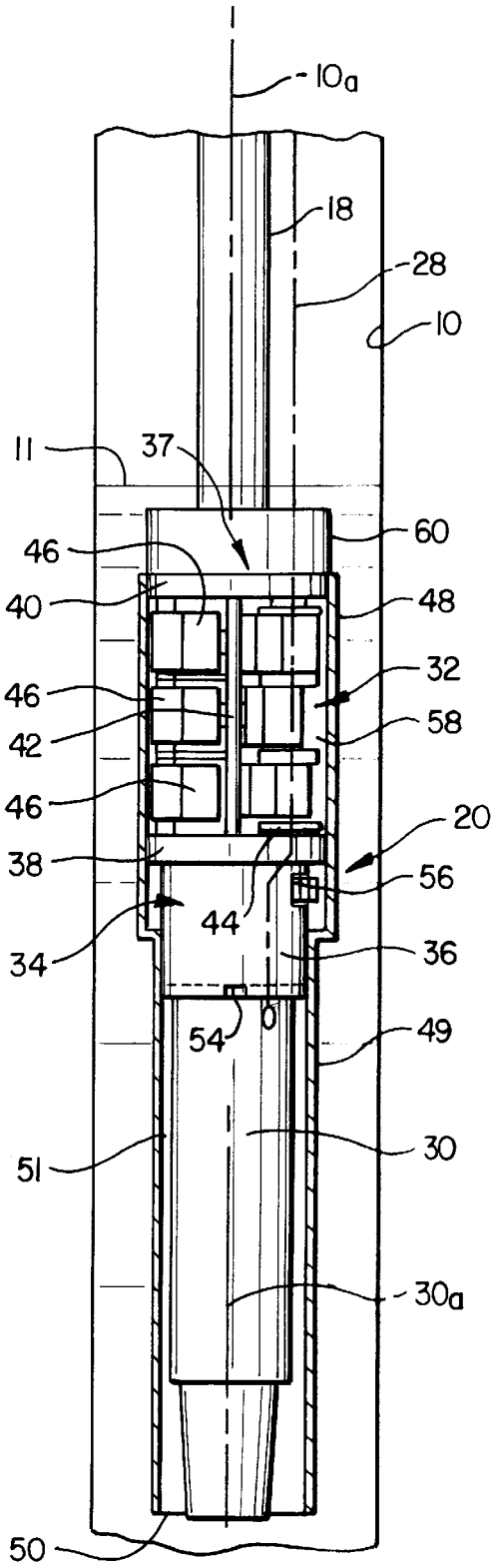
FIG. 2 is a detail view of one embodiment of the pump of the invention directly connected to a submersible electric motor through a speed reduction gear drive mechanism showing the pump and motor disposed on the end of a well fluid conducting conduit which also supports the pump and motor in the well.

Referring now to FIG. 2, further details of the pump unit 20 are illustrated. In one preferred pump unit according to the invention a submersible in-the-hole AC electric motor 30 is utilized in the pump unit 20 and is connected to a multi-cylinder, preferably triplex, reciprocating plunger pump 32 by way of a speed reduction gear drive unit 34. The speed reduction gear drive unit 34 includes a housing 36 suitably connected to the motor 30 and to a frame 37 for the pump 32. Pump frame 37 preferably includes spaced apart generally circular frame plates 38 and 40 which are interconnected by elongated beam members 42, one shown in FIG. 2. The pump frame 38, 40, 42 is operable to support a rotatable eccentric or crankshaft 44 and three inline cylinders 46 disposed between the frame plates 38 and 40.

An elongated cylindrical tubular shroud 48 is sleeved over the frame plates 38 and 40 and includes a reduced diameter section 49 sleeved over the speed reduction unit housing 36 and the motor 30 and extending to an inlet opening 50 for well fluid entering the pump unit 20. The entire pump unit 20 may be submerged in well fluid 11 and at least the pump unit inlet 50 is required to be submerged in such fluid. In operation, the pump unit 20 draws working fluid from the wellbore of well 10 through the opening 50 to flow through an annular channel 51 formed between the reduced diameter section 49 of the shroud 48 and the motor 30 and through passages 54, one shown in FIG. 2, in the housing 36, then through an exit port 56 in the housing and through suitable ports, not shown in FIG. 2, into a crankcase space 58 defined within the shroud 48 and between the pump frame plates 38 and 40. Working fluid flows, in a unique manner to be described further herein, through the pump 32 for discharge into an accumulator space which is formed in an adapter head member 60 to be described in further detail herein, and from the head member 60 up through the conduit 18, 19 to the storage tank 22. Pump 32 is advantageously mounted above motor 30 and arranged to have its crankshaft axis of rotation 44*a*, see FIG. 3, generally parallel to motor axis 30*a* and the central axis 10*a* of the well 10 at the working location of the pump.

Figure 3:
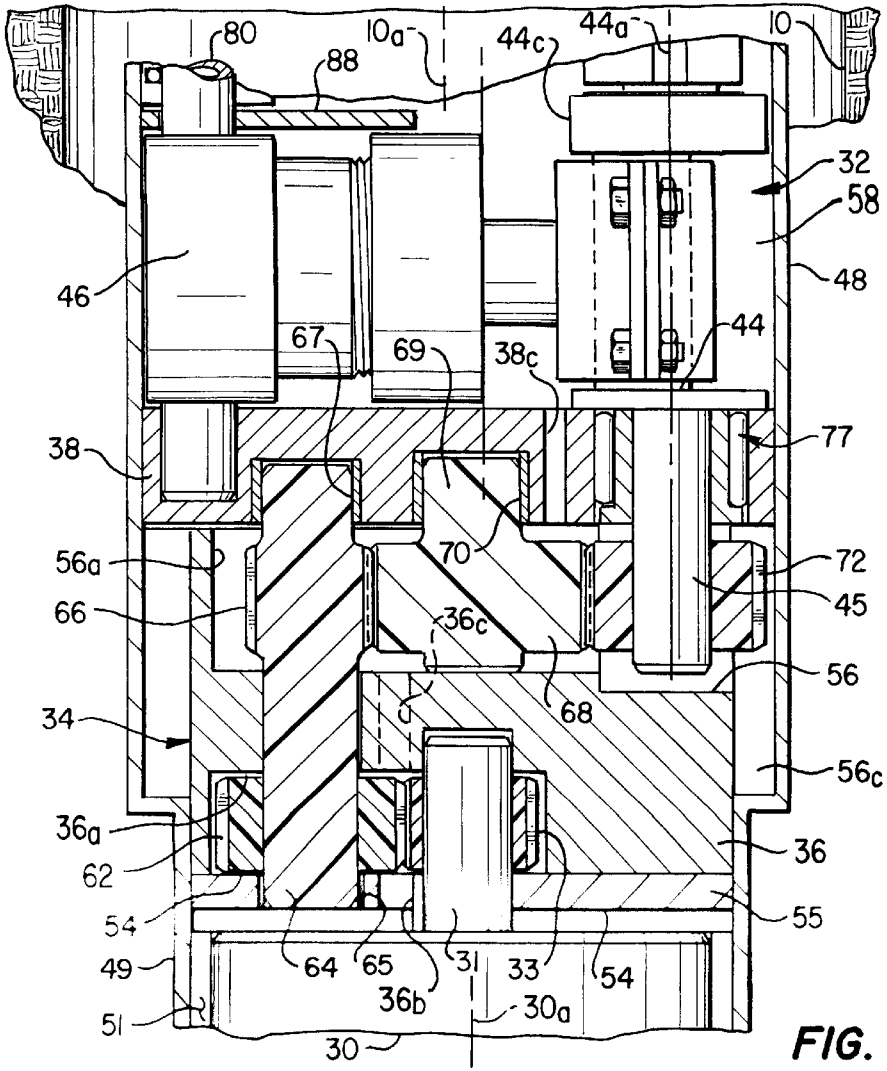
FIG. 3 is a detail central longitudinal section view through the speed reduction gear mechanism of the pump embodiment of FIGS. 1 and 2.

Referring now to FIG. 3, further details of the gear reduction drive unit 34 are illustrated. The drive unit housing 36, as previously mentioned, includes generally radially extending fluid inlet passages 54, two shown in FIG. 3, which extend from the outer periphery of the housing 36 and are in fluid flow communication with the annualar channel 51 between the motor 30 and the shroud portion 49. Specifically, the passages 54 are disposed in a separable end plate part 55 of the housing 36. The motor 30 includes a rotary output shaft 31 on which is suitably mounted a pinion 33 for rotation with the shaft and meshed with a driven gear 62 supported on a shaft 64 for rotation therewith. Shaft 64 includes an integral pinion 66 which is drivingly connected to an idler gear 68 supported in housing 36 on a suitable stub shaft part 69 and mounted in a sleeve bearing 70 disposed in a suitable bore in the pump frame plate 38, as shown. In like manner, shaft 64 is suitably mounted for rotation in spaced apart bearings 65 and 67 disposed in the housing cover 55 and the frame plate 38, as illustrated. Bearings 67 and 70 may also, if desired be mounted in a separable end plate, not shown, for housing 36.

Referring further to FIG. 3, the pump crankshaft or eccentric 44 includes a stub shaft part 45 on which is mounted for rotation therewith a driven gear 72 meshed with gear 68. Accordingly a suitable speed reduction gear drive is provided by the gears 33, 62, 66, 68 and 72 to reduce the rotational speed of the crankshaft 44 with respect to shaft 31. For example, in a pump having a displacement to provide about 2.0 gallons per minute output at working pressures up to at least about 500 psig, the motor 30 may comprise a single phase AC electric motor of 0.50 horsepower rating at 3450 rpm output of the shaft 31 and the speed reducing gear train reduces the operating speed of the crankshaft 44 to approximately 825 rpm. Other gear reduction ratios may, of course, be provided.

An advantageous feature of the gear reduction drive unit 34 is provided by the arrangement of the gears 33 and 62 which are disposed in a suitable cavity 36*a* formed in the housing 36. The passages 54 are in communication with an inlet port 36*b* to the cavity 36*a* and a second port 36*c* is suitably arranged in a conventional manner to provide for the gears 33 and 62 to form a gear pump for drawing working fluid, such as water, through the channel 51, the passages 54, the port 36*b* for discharge through port 36*c* into a cavity 56*a* in communication with the port 56 in housing 36. Port 56 is in communication with an annular space 56*c*, FIG. 3, formed between the exterior of the housing 36 and the shroud 48 and which is in communication with the space 58 between the pump frame plates 38 and 40 by way of one or more passages 38*c*, one shown, in frame plate 38 and also by way of a bearing 77 which supports the stub shaft part 45 of crankshaft 44 in the frame plate 38. Accordingly, water is drawn through the channel 51, to flow over the motor 30 to provide cooling therefor and then flows through the gear reduction drive unit 34 as described. In this way well production water also lubricates the gears 33, 62, 66, 68 and 72 while further lubricating the bearings which support the shafts 64 and 69 as well as the bearings 77. In this regard the gears 33, 62, 66, 68 and 72 are preferably formed of a polymeric material such as nylon, a molybdenum impregnated nylon or a polytetrafluoroethylene composition commercially available and known as Industrial Grade Teflon. Other water lubricatable materials may be used for these components.

Figure 4:
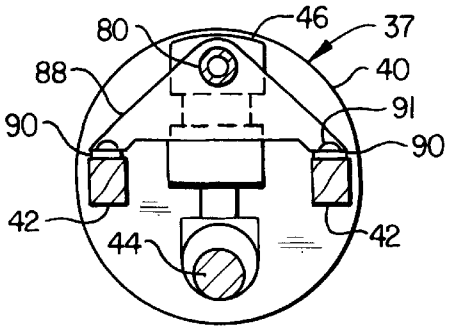
FIG. 4 is a section view taken along the line 4—4 of FIG. 5.
Figure 5:
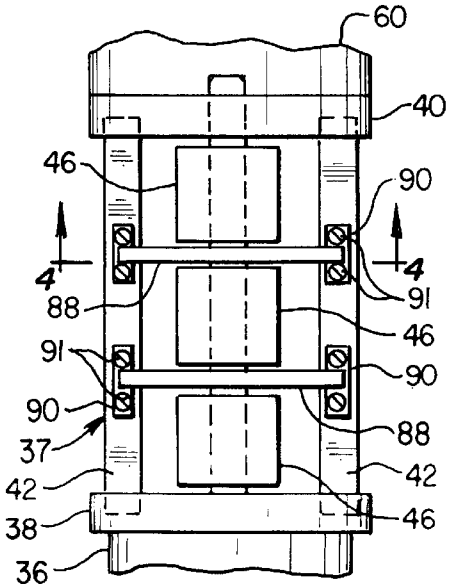
FIG. 5 is a detail elevation showing one preferred configuration of a frame for the multi cylinder plunger pump.

Referring further to FIG. 2 and, particularly, FIGS. 4 and 5, the frame 37 for the pump 32 is of particularly unique construction, as illustrated. The frame plates 38 and 40, as previously mentioned, are interconnected by longitudinal spaced apart beams 42 the opposite ends of which, respectively, are disposed in suitable recesses in each of the frame plates and are secured thereto by conventional mechanical fasteners, not shown. An elongated cylindrical tubular fluid discharge manifold 80 extends between and is supported by the frame plates 38 and 40, see FIG. 6 also. The manifold 80 includes an internal passage 82 which is closed at one end by suitable means, such as a threaded plug 84, FIG. 6, and opens at the opposite end into an accumulator cavity 86 formed in the adapter head member 60. A suitable pressure fluid or spring biased accumulator diaphragm or piston, not shown, may be supported on member 60 and exposed to passage 86 to reduce pressure pulsations.

Referring further to FIGS. 4 and 5, the frame 37 further includes spaced apart transversely extending platelike support brackets 88, which journal the manifold 80 and are secured to the beams 42 at opposite ends by respective flange members 90. The support brackets 88 may be secured to the beams 42 at the flanges 90 by conventional mechanical fasteners 91. Accordingly, a rigid, lightweight frame 37 is provided by the members 38, 40, 42 and 88 and these members may be made of conventional corrosion resistant metals or plastics.

Figure 6:
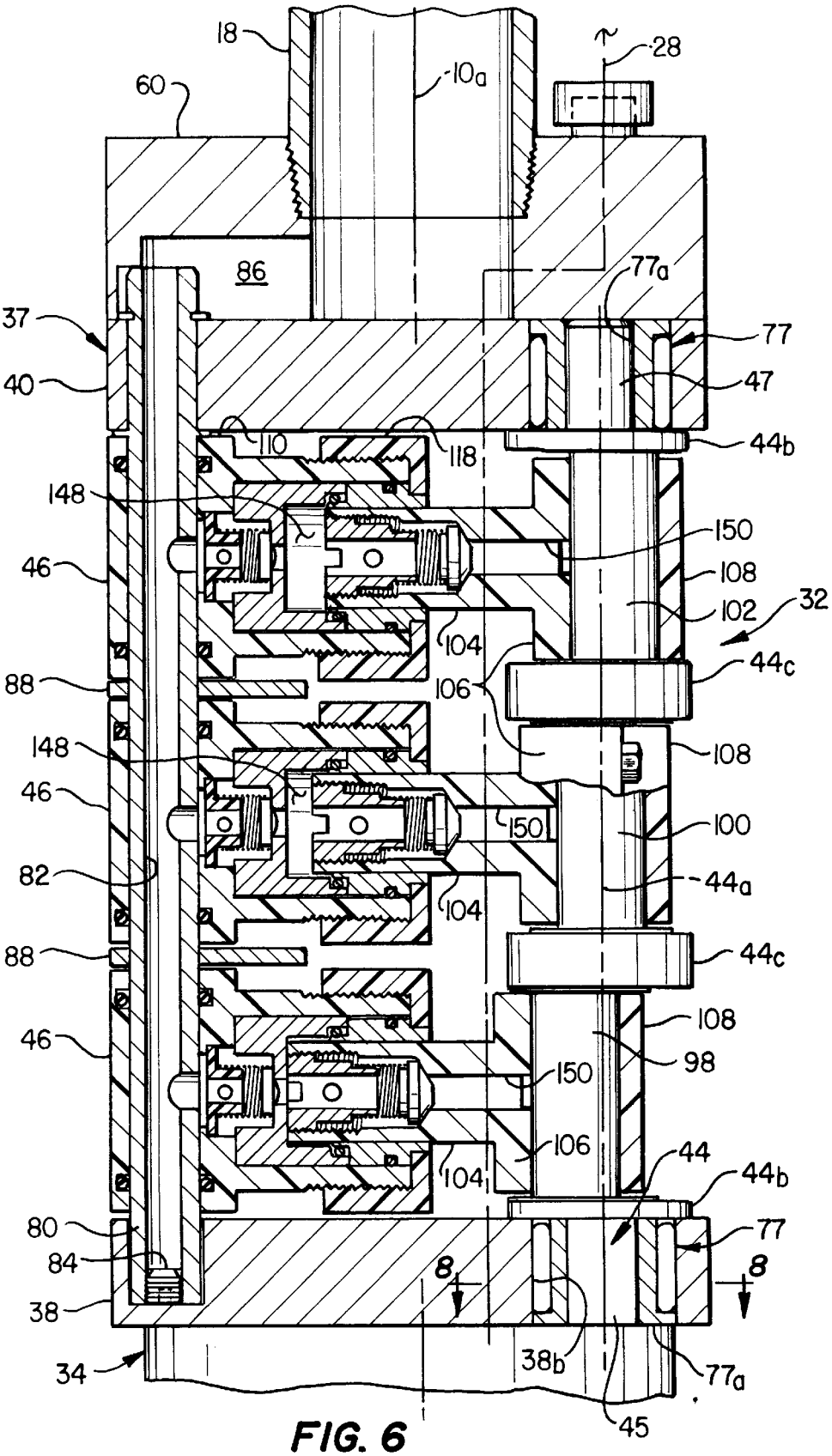
FIG. 6 is a longitudinal central section view through the embodiment of the pump illustrated in FIGS. 1 through 5.

Referring further to FIG. 6, the pump 32, as previously mentioned, is preferably a triplex type. The crankshaft 44 includes three axially spaced apart crank throws defined by cylindrical journals 98, 100 and 102 disposed between spaced apart flanges 44*b* and 44*c*, as shown, and between the shaft part 45, which is supported in the frame plate 38, and a stub shaft part 47 journaled for rotation in a bearing 77 in the frame plate 40. Each of the cylinders 46 includes a reciprocating, generally cylindrical piston or plunger 104 connected to a respective one of the crank throw journals 98, 100 and 102 in a generally conventional way by a connecting head portion 106 which is releasably connectable to a semicylindrical bearing cap 108 in a conventional manner. Each of the plungers 104 is disposed for reciprocating movement in its respective cylinder 46 to vary the displacement of an expansible chamber therein and to displace fluid into the passage 82 of the manifold 80 in response to rotation of the eccentric or crankshaft 44*a*.

Figure 7:
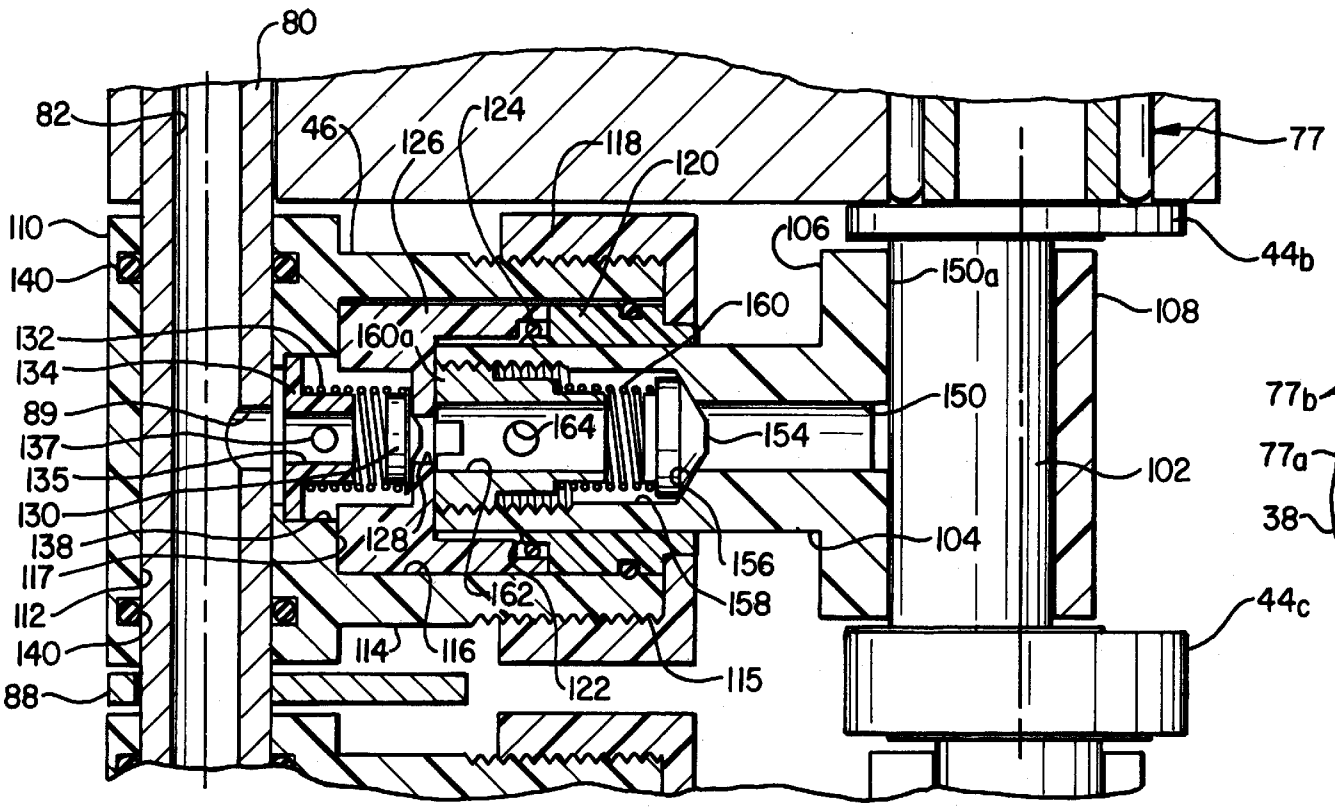
FIG. 7 is a detail section view on a larger scale of one of the pump cylinders and plungers.

A more detailed description of one of the cylinders 46 and its associated plunger 104 will now be set forth in conjunction with FIG. 7, in particular. Referring to FIG. 7, each of the cylinders 46 includes a cylinder head part 110, which is provided with a transverse bore 112 for receiving the tubular manifold 80. The cylinder 46 further includes a generally cylindrical skirt 114 extending normal to the bore 112 and having a cylindrical bore 116 formed therein. The distal end of the skirt 114 is suitably threaded at 115 to receive a removable cylinder cap 118, as shown.

The cap 118 retains a cylindrical plunger liner member 120 in the bore 116. Liner 120 includes a peripheral, resilient seal lip 122 formed thereon and operable to be biased into sealing engagement with the plunger 104 by a garter spring 124. Garter spring 124 is retained in its working position by a generally cylindrical discharge valve seat and spring retainer 126 disposed in the bore 116 and engageable with a cylinder bore transverse end wall 117. Seat member 126 includes a cylinder discharge passage 128 formed centrally therein and operable to be closed by a poppet type discharge valve closure member 130 which is biased to its closed position by a coil spring 132. Coil spring 132 is sleeved over a removable spring retainer 134 disposed in an axial counterbore 138 formed in cylinder head portion 110. Spring retainer 134 includes an axial passage 135 formed therein and radially disposed passages 137, one shown, intersecting passage 135. Passages 135, 137 communicate with a passage 89 formed in manifold 80 and intersecting passage 82. Suitable O-ring seals 140 are disposed in the cylinder head 110, as shown in FIG. 7, for sealing engagement with the outer wall of the tubular manifold 80 to prevent leakage of working fluid being discharged from the cylinder 46.

In FIG. 7 the plunger 104 is shown in its top dead center position which has reduced an expansible chamber 148, see FIG. 6, to substantially nil as fluid is displaced from the chamber in response to rotation of the crankshaft 44. Thanks to the circumferencial spacing of the crank throws or journals 98, 100 and 102 the respective expansible chambers 148 of each cylinder 46 discharge their working fluid in sequence.

Referring further to FIG. 7, each plunger 104 is provided with a particularly advantageous arrangement of a fluid inlet port to the chamber 148, including a central axial passage 150 extending thereto and intersecting a bore 150*a* formed by the plunger bearing head 106 and the cap 108. In this way the bearing formed by each crank throw experiences working fluid flow through the clearance space between the bore 150*a* formed by cap 108, and head 106 and the surface of the associated journal 102, shown in FIG. 7, and through the passage 150 to a poppet valve closure member 154, which is engagable with a seat surface 156 formed between the passage 150 and an enlarged bore portion 158. A coil spring 160 biases the valve poppet 154 toward the closed position and is supported by a generally tubular spring retainer 160 threadedly engaged with a threaded portion of bore 158, as illustrated. Spring retainer 160 includes axial and radial passages 162 and 164 formed therein, as shown, to allow working fluid to be drawn into the expansible chamber 148 during a downstroke of the plunger 104.

Accordingly, as the plunger 104 moves from the position shown in FIG. 7 to the position shown in FIG. 6 in response to rotation of the crankshaft 44, fluid is drawn into the chamber 148 through the clearance spaces formed between the respective crank journals 98, 100 and 102, respectively, and through the passages 150 to unseat the valve closure members 154 and allow fluid to fill chambers 148. As the plungers 104 each move toward a position to reduce the volume of the associated expansible chamber 148, valve poppet 138 is unseated and fluid is displaced through passages 135, 137 and 89 into manifold passage 82. As the crankshaft 44 rotates, the cylinders 46 oscillate to follow the orbital motion of the plungers 104, thereby eliminating the need for a crosshead or a wrist pin and bearing connection between each plunger and the crankshaft. Cylinder head 110, cap 118 and members 120 and 126 may be formed of a suitable corrosion resistant materials such as nylon or other suitable materials for submersible pump applications. In like manner, the other components of each cylinder 46 may be manufactured out of suitable engineering materials used for pumps working with corrosive as well as noncorrosive fluids. Plunger 104 and head part 106 may be integrally formed of a suitable material, such nylon or molybdenum filled nylon and which is adapted to be lubricated by water. Crank journals 98, 100 and 102 may be polished stainless steel or provided with a bearing sleeve of one of the aforementioned polymer materials. The journal bearings shown in FIGS. 6 and 7 for the crank journals 98, 100 and 102 may be modified to use rolling element bearings, such as the bearings 77.

Figure 8:
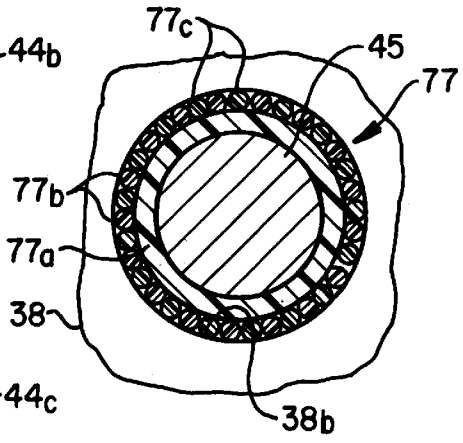
FIG. 8 is a section view taken along the line 8—8 of FIG. 6 and showing a preferred roller bearing for the pump of the present invention.

Referring briefly to FIG. 8, the rolling element bearing 77 is shown disposed in a bearing bore 38*b* in frame plate 38 and preferably includes inner bearing race 77*a* comprising a flanged cylindrical tubular member, and elongated cylindrical rollers 77*b* and 77*c*. The rollers 77*b* and 77*c* are arranged alternately around the inner race 77*a* and are preferably, for water lubricated applications, formed of industrial grade Teflon and nylon, respectively. The sleeves or inner races 77*a* may be formed of a molydenum filled or impregnated nylon sold under the trademark Nylatron, or a non-filled nylon material. The use of rollers or needles formed in such a manner has been indicated to be advantageous for applications wherein water is the bearing lubricant. As mentioned previously this bearing configuration may be used in place of the plain journal bearings for each of the pump pistons or plungers 104, for example.

The construction and operation of the pumping unit 20 is believed to be readily understandable to one of ordinary skill in the art from the foregoing description. Thanks to the configuration of the pump 32 and the arrangement for intake of working fluid to each of the expansible chambers 148, the motor 30 is cooled, the chambers 148 are adequately charged, particularly when the gear reduction drive mechanism 34 is utilized, and the pump is advantageously lubricated at the crank journal bearings by drawing the working fluid into each of the expansible chambers 148 through the bearings, respectively, and through the central passages formed in the respective pistons or plungers 104 In operation, the pump 32 draws fluid into the respective expansible chambers in the manner just described and discharges fluid into the passage 88 for flow through the accumulator passage 86 and into the conduit 18 for transport to the surface and for whatever use is required thereafter.

Figure 9:
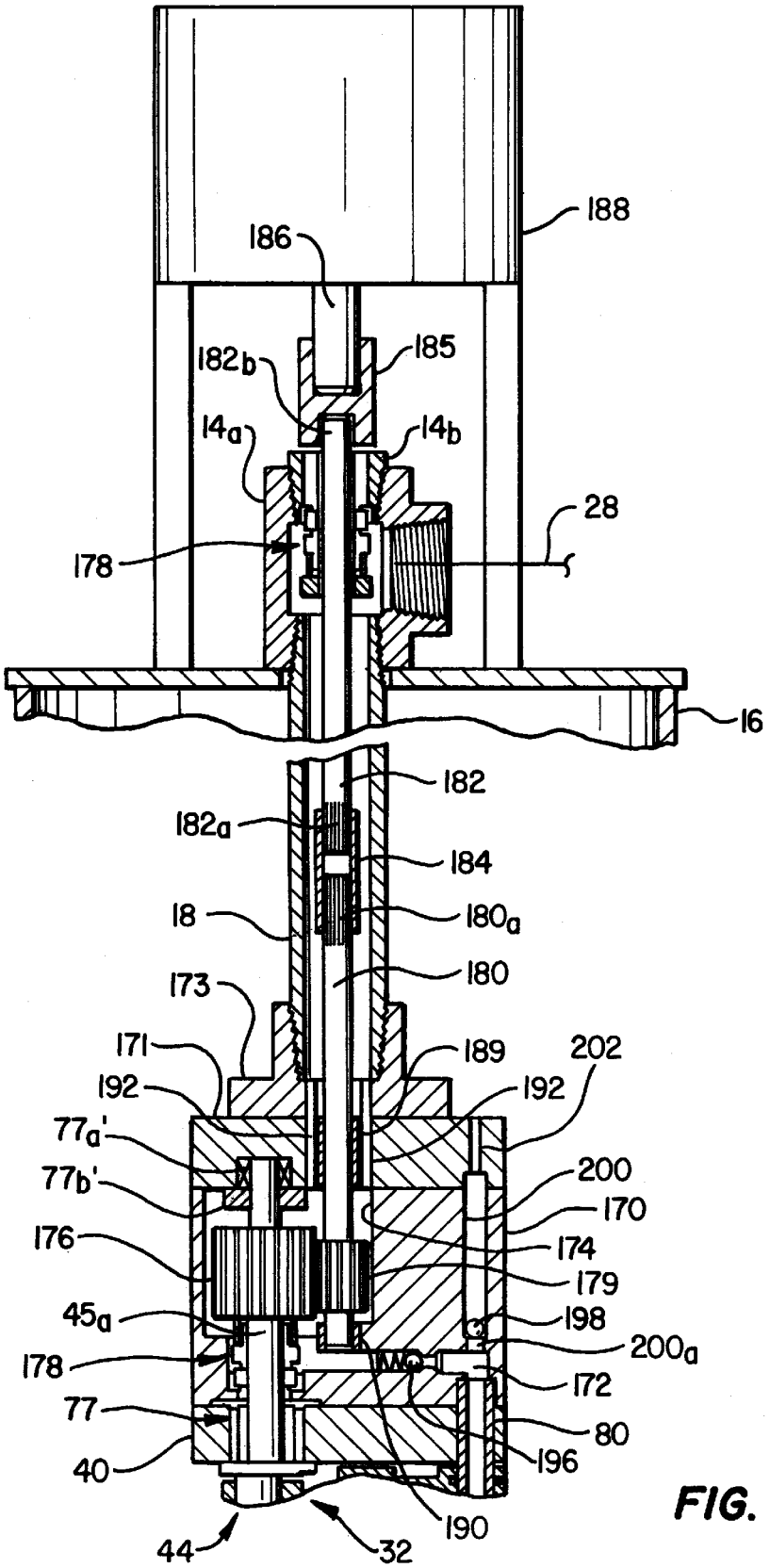
FIG. 9 is a detail section view showing an alternate embodiment of the pump adapted to be driven from the surface by an elongated rotary drive shaft or rod.

Referring now to FIG. 9, the pump 32 is shown in a modified form wherein the eccentric or crankshaft 44 has a modified shaft extension 45*a* extending into a housing 170 suitably secured to the frame plate 40. The housing 170 includes a fluid passage 172 in fluid flow receiving communication with the manifold 80 for receiving pressure fluid discharged from the pump cylinders. Passage 172 opens into a cavity 174 formed in the housing 170 and into which the shaft 45*a* extends, as shown. Shaft 45*a* includes a distal end part suitably supported in a radial roller type bearing 77*a* and engaged with a thrust bearing 77*b*. A drive gear 176 is supported on shaft 45*a* and suitably secured thereto for rotation with the shaft. A conventional mechanical type shaft seal assembly 178 is interposed the frame plate 40 and the gear 176 and disposed around the shaft 45*a* to prevent leakage of high pressure fluid from the cavity 174 back into bearing 77 in frame plate 40.

Drive gear 176 is meshed with a drive pinion 179 disposed in cavity 174 and suitably secured for rotation with a drive shaft member 180 extending from the housing 170, including its end cover 171. Shaft member 180 extends within tubing 18 which is secured to a tubing flange member 173, also secured to the housing end cover 171 in a suitable manner. Drive shaft member 180 is coupled to an elongated, rod-like rotary drive shaft 182 by a suitable coupling 184 comprising, for example, an internally splined tube, as shown, or a tubular member having a polygonal internal cross section cooperable with the ends 182*a* and 180*a* of the drive shaft members 182 and 180 to provide a suitable drive coupling which will allow some axial and radial excursion of the shaft members with respect to each other.

The upper end of drive shaft 182 extends through a wellhead assembly 14*a* suitably mounted on the surface casing 16 and suitably connected to discharge conduit 28. Wellhead assembly 14*a* is connected to tubing 18 for receiving working fluid discharged from the pump 32. A mechanical shaft seal assembly 178 is also supported on the upper end of shaft 182 and engaged with a bushing member 14*b* of wellhead assembly 14*a* to prevent unwanted discharge of working fluid alongside the upper distal end 182*b* of shaft 180. Shaft end 182*b* is suitably connected to a coupling 185 which is also coupled to the output shaft 186 of a rotary drive motor 188 suitably mounted on the wellhead assembly 14*a* for driving the pump crankshaft 44 by way of the drive shaft 182, shaft 180, pinion 179, gear 176 and crankshaft extension 45*a*.

As mentioned previously, working fluid discharged from manifold 80 flows through passage 172 and into cavity 174 wherein it is operable to cool and lubricate the shaft seal assembly 178, the gears 179 and 176, bearings 77*a* and 77*b* and bearings 189 and 190 which support shaft 180 for rotation in the housing 170 and its cover member 171. Plural circumferentially spaced apart passages 192 are disposed around bearing 189 and extend between the cavity 174 and tubing 18 for conducting working fluid discharged from the pump 32 from the cavity 174 into the tubing 18.

A spring biased check valve 196 is interposed in passage 172 and a pressure relief valve closure member 198 is interposed in an enlarged diameter passage 200 which is in communication with a reduced diameter discharge passage 202 opening to the exterior of the cover member 171. When working fluid is being discharged from the manifold 80 into passage 172 valve 196 is unseated to allow fluid flow into the cavity 174 and up through the tubing 18 while at the same time valve closure member 198 moves through passage 200 to close over passage 202 to prevent unwanted discharge of working fluid back into the well. However, when the pump 32 is inoperable check valve 196 prevents backflow of working fluid into the manifold 80 while at the same time closure member 198 moves generally to the position shown in the enlarged passage 200 to allow working fluid to vent from manifold 80 and passage 172 through passage 202 so that, upon startup of the pump 32, minimal fluid back pressure is exerted on the pump plungers. A reduced diameter passage portion 200*a* interconnects passage 200 with passage 172.

Accordingly, the modified pump 32 illustrated in FIG. 9 enjoys all of the benefits of the embodiment described and shown in conjunction with FIGS. 1–8 while being adapted for drive from the earth's surface or from a position of a drive motor substantially uphole from the working position of the pump.

Although preferred embodiments of the invention have been described in detail herein, those skilled in the art will recognize that various substitutions and modifications may be made without departing from the scope and spirit of the appended claims.

What is claimed is:

1. A multi-cylinder reciprocating plunger pump for downhole pumping of well fluids to the surface, comprising:

a frame including spaced apart support members;

a crankshaft including crank throws formed thereon rotatably supported on said frame;

plunger means connected to each of said crank throws, respectively, for reciprocal movement with respect to said frame;

cylinders mounted on said frame and cooperable with respective ones of said plungers means to form respective expansible pumping chambers therein, each of said cylinders being supported on said frame for movement in response to rotation of said crankshaft;

a fluid discharge manifold operably connected to each of said cylinders and including fluid discharge passage means formed therein for receiving fluid from each of said cylinders for discharge to a well conduit connected to said pump; and drive means connected to said crankshaft for rotatably driving said crankshaft to pump well fluid through said conduit to the surface.

2. The pump set forth in claim 1 wherein:

said frame is configured to support said crankshaft for rotation about and axis substantially parallel to a central axis of said well.

3. The pump set forth in claim 1 wherein:

said drive means comprises a submersible electric motor drivably connected to said crankshaft.

4. The pump set forth in claim 3 including;

speed reduction gear drive means interposed between an output shaft of said motor and said crank shaft for reducing the speed of rotation of said crank shaft with respect to the speed of rotation of said output shaft.

5. The pump set forth in claim 4 wherein:

said speed reduction drive means includes a housing, a fluid inlet passage in said housing in communication with a cavity in said housing, cooperating gear means in said cavity drivingly interconnecting said output shaft with said crankshaft and operable to pump well fluid through passage means in said housing to said pump.

6. The pump set forth in claim 5 including;

bearing means for supporting said gears of said speed reduction drive means in said housing and lubricated by said well fluid.

7. The pump set forth in claim 5 including:

an elongated shroud disposed in sleeved relationship around said motor and defining an annular flow channel for well fluid to flow along said channel to said inlet passage to said housing for cooling said motor.

8. The pump set forth in claim 7 wherein:

said shroud is at least partially supported by said frame and forms an enclosure for said crankshaft, said plungers and said cylinders of said pump, said enclosure being in fluid flow communication with said annular channel by way of said passages in said housing.

9. The pump set forth in claim 1 wherein:

said discharge manifold comprises an elongated tubular member supported by said support members of said frame and said cylinders are mounted on said manifold for oscillating movement with respect thereto, respectively.

10. The pump set forth in claim 9 wherein:

each of said cylinders includes a head portion having a first bore formed therein and adapted to be disposed in sleeved relationship over said discharge manifold, said head portions having respective passages formed therein cooperable with passage means in said discharge manifold for discharging fluid from said cylinders into said discharge manifold.

11. The pump set forth in claim 10 including:

a second bore formed in said head portion of said cylinders, respectively and extending normal to said first bore, a discharge valve retainer disposed in said second bore for retaining a fluid discharge valve in said head portion and a cover for said head portion removably supported thereon for retaining said discharge valve retainer in said head portion.

12. The pump set forth in claim 11 including;

a generally annular cylinder liner removably disposed in said second bore between said cover and said discharge valve retainer and including an annular seal lip engagable with said plunger to provide a seal for said plunger between said expansible chamber and the exterior of said cylinder.

13. The pump set forth in claim 12 including:

circular elastic ring member engagable with said seal lip for biasing said seal lip into engagement with said plunger.

14. The pump set forth in claim 1 wherein:

each of said plungers includes a cavity formed therein and a fluid inlet valve disposed in said cavity and operable to valve fluid to said expansible chamber in response to reciprocation of said plunger in said cylinder.

15. The pump set forth in claim 14 wherein:

said plungers each include a fluid inlet passage in communication with said fluid inlet valve and with a head portion of said plunger, said passage opening into a bearing bore formed in said head portion of said plunger.

16. The pump set forth in claim 15 wherein:

said bearing bore is formed by said head portion of said plunger and a removable cap for supporting said plunger on said crank throw.

17. The pump set forth in claim 14 wherein:

said fluid inlet valve includes a valve retainer member removably disposed in said cavity in said plunger for retaining a valve closure member therein and closing over said fluid inlet passage in said plunger.

18. The pump set forth in claim 1 including:

bearing means for supporting said crankshaft for rotation in said frame and lubricated by well fluid, said bearing means comprising a bearing sleeve disposed on a journal formed on said crank shaft at spaced apart points thereon, and a plurality of rollers engabable with said sleeve and interposed between said sleeve and said support member, respectively, said rollers being formed of a polymer material selected from one of nylon and polytetrafluoroethylene.

19. The pump set forth in claim 18 wherein:

alternate ones of said rollers are formed of polytetrafluoroethylene and alternate ones of said rollers are formed of nylon.

20. The pump set forth in claim 1 wherein:

said drive means comprises an elongated rotatable rod operably connected to one end of said crankshaft and extending within said conduit, said rod being operably connected to drive motor means.

21. The pump set forth in claim 20 wherein:

said drive means further comprises a speed reducing gear drive interposed in a housing connected to said frame and including a drive gear operably connected to said crankshaft, and passage means in said housing in communication with said discharge manifold and said conduit for communicating well fluid to said conduit for flow to the surface.

22. The pump set forth in claim 21 including:

a check valve interposed in said passage means and a pressure relief valve operably connected to said passage means for relieving fluid pressure in said manifold when said pump is inoperable to minimize starting effort exerted on said pump.

23. The pump set forth in claim 21 including:

seal means disposed on said crankshaft between said drive gear and said frame to minimize leakage of working fluid from said housing.

24. A submersible multicylinder reciprocating plunger waterwell pump comprising:

a frame including a spaced apart support members;

a crankshaft mounted on said frame for rotation about an axis generally parallel to a central longitudinal axis of a well for receiving said pump therein;

plural plungers connected to said crankshaft at spaced apart points thereon for reciprocal movement with respect to said frame in response to rotation of said crankshaft;

a tubular discharge manifold mounted on said frame between said support members;

plural cylinders mounted on said frame and supported by said discharge manifold, respectively, said cylinders being cooperable with the respective ones of said plungers to form respective expansible pumping chambers therein;

respective fluid inlet and discharge valves for admitting and discharging well water from respective ones of said expansible chambers; and bearing means for supporting said crankshaft on said frame interposed between said plungers and said crankshaft, said bearing means being lubricated by said water prior to admitting said water to said expansible chambers.

25. The pump set forth in claim 24 wherein:

at least selected ones of said bearing means comprise a plurality of rollers disposed between at least one of said crankshaft in said frame and said crankshaft and said plunger means, said rollers being formed of a polymer material selected from one of nylon and polytetrafluoroethylene.

26. The pump set forth in claim 24 wherein:

said cylinders are mounted on said manifold for oscillatory movement with respect to said frame in response to rotation of said crankshaft.

27. The pump set forth in claim 24 wherein:

said fluid inlet valves are disposed on said plungers, respectively and said plungers include fluid inlet passage means formed therein and in communication with said bearing means formed between said plungers and said crankshaft, respectively.

28. The pump set forth in claim 24 including:

a drive motor operably connected to said frame and a speed reduction gear drive unit interposed between said crankshaft and an output shaft of said motor, said speed reduction gear drive unit including gear means and bearing means supporting said gear means, said gear means and said bearing means supporting said gear means being lubricated by water flowing within said well.

29. The pump set forth in claim 28 wherein:

said speed reduction gear drive unit includes a charging pump formed by said gear means for pumping well water through said speed reduction gear drive unit to said inlet passages in said plunger pump.

30. The pump set forth in claim 24 wherein:

said crankshaft includes drive means formed thereon for connecting said crankshaft to an elongated rotatable rod extending within a conduit in said well, said conduit supporting said pump in said well and said rod being driveably connected to said crankshaft.

* * * * *